United States Patent [19]

Komatsu et al.

[11] 4,218,594

[45] Aug. 19, 1980

[54] ROTARY SWITCH ASSEMBLY

[75] Inventors: Hiroki Komatsu; Tsumoru Oka, both of Miyagi, Japan

[73] Assignee: Alps Electric Co., Ltd., Tokyo, Japan

[21] Appl. No.: 925,995

[22] Filed: Jul. 19, 1978

[30] Foreign Application Priority Data

Jul. 21, 1977 [JP] Japan ..... 52-97514[U]

[51] Int. Cl.[2] ..... H01H 19/46

[52] U.S. Cl. ..... 200/11 G; 200/291; 200/303

[58] Field of Search ..... 200/11 R, 11 A, 11 C, 200/11 EA, 11 DA, 11 G, 11 K, 11 TW, 17 R, 14, 155 R, 291, 292, 303, 307, 11

[56] References Cited

U.S. PATENT DOCUMENTS

| | | | |
|---|---|---|---|
| 3,255,319 | 6/1966 | Paine | 200/11 G X |
| 3,284,584 | 11/1966 | Didyk | 200/291 X |
| 3,579,257 | 5/1971 | Spreitzer | 200/292 X |
| 3,594,527 | 7/1971 | Brant et al. | 200/293 X |
| 3,958,087 | 5/1976 | Mol et al. | 200/307 X |
| 4,006,442 | 2/1977 | Mega | 338/180 |
| 4,145,585 | 3/1979 | Iwasaki | 200/11 G |

*Primary Examiner*—James R. Scott

*Attorney, Agent, or Firm*—Guy W. Shoup; Gerard F. Dunne

[57] ABSTRACT

A switch having a small thickness and constructed easily from a reduced number of parts comprises two complementary molded switch case members, each of which has fixed contacts with terminals integrally formed therewith and a common contact with a terminal integrally formed therewith. An operation member consisting of a disc portion and a stopper portion integrally formed therewith is provided between the case members and movable contacts having contact projections on their outer surfaces are secured to respective side surfaces of the disc portion of the operation member. A shaft member passes through the case members, the movable contacts and the operation member and is held in place with a fastener member. The upper portions of the case members are formed so as to define a slot therebetween which restricts rotary movement of the stopper portion projecting from the operation member.

13 Claims, 5 Drawing Figures

Fig. 3a
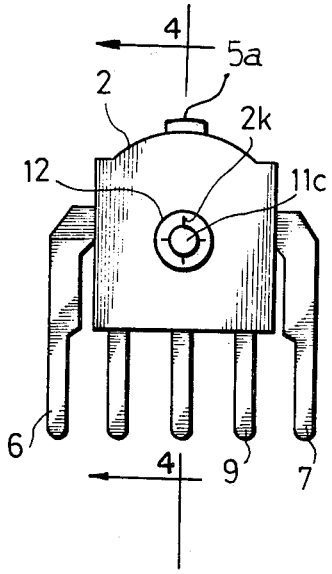
Fig. 3b
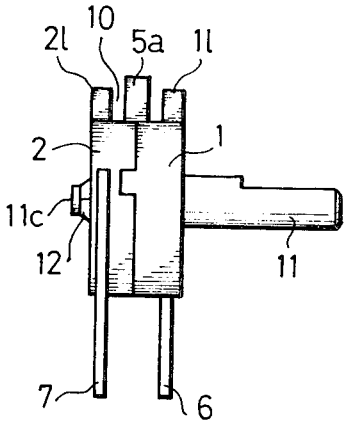
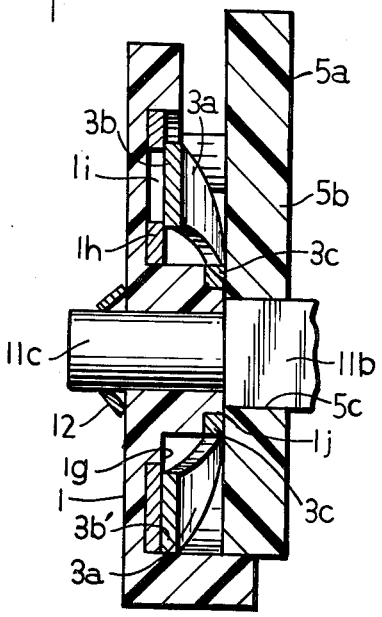
Fig. 4

ROTARY SWITCH ASSEMBLY

BACKGROUND OF THE INVENTION

The present invention relates to a switch and, more particularly, to a switch having a small thickness and made from a reduced number of parts so it can be assembled easily.

SUMMARY OF THE INVENTION

An object of the present invention is to provide a small switch having a small thickness and which may be constructed simply from a reduced number of molded parts.

To this end, according to the present invention, a switch is provided which includes first and second case members adapted to be joined together, each of which has a central aperture, a generally circular recess in the inner surface thereof and a plurality of fixed contacts integrally formed with the respective case member to fit within the recess thereof. A respective common fixed contact is also integrally formed with each case member to fit within the recess thereof. An operation member is rotatably disposed between the first and second case members and has a central aperture. A first movable contact member having a central aperture is secured to one face of the operation member and is slidable on the contacts disposed within the recess in the first case member, and a second movable contact member having a central aperture is secured to the other face of the operation member and is slidable on the contacts disposed within the recess in the second case member. A rotary shaft is passed through the apertures in the first and second case members, first and second movable contacts and operation member. A retaining member is attached to an end portion of the shaft for maintaining the first and second case member in a tightly joined state.

The above and other objects as well as advantageous features of the present invention will become apparent from the following description of the preferred embodiment taken in conjunction with the accompanying drawings.

BRIEF DESCRIPTION OF THE DRAWINGS

FIG. 3A is a rear elevation view and FIG. 3B is a side elevation view of the embodiment shown in FIG. 1;

FIG. 4 is a enlarged sectional view taken along line 4—4 of FIG. 3.

DESCRIPTION OF THE PREFERRED EMBODIMENT

An embodiment of the present invention will be described with reference to the accompanying drawings.

Figure 1:
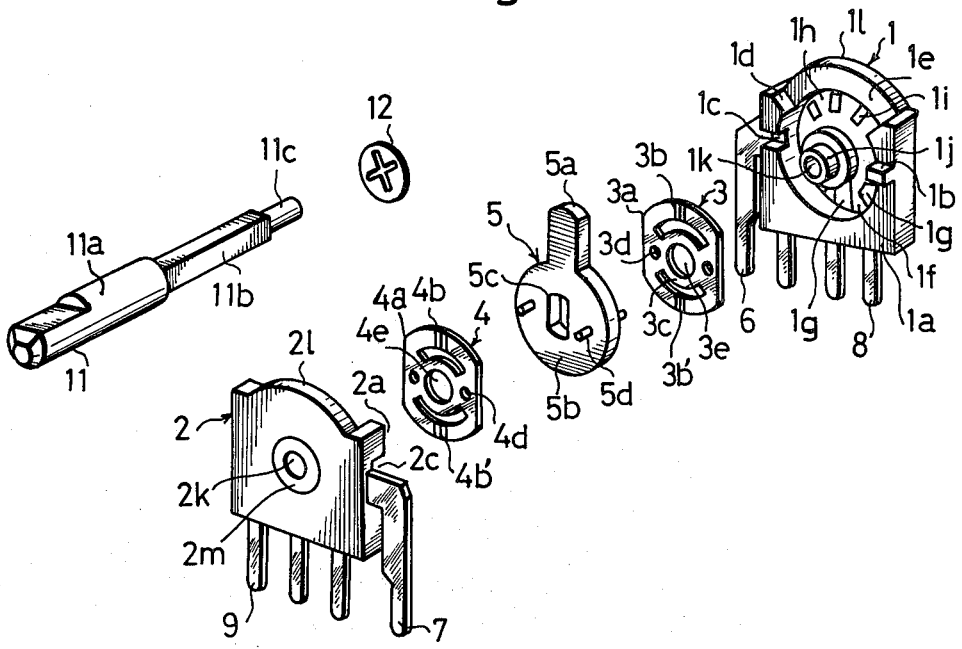
FIG. 1 is an exploded view of an embodiment of the present invention.

FIG. 1 shows perspectively each of the parts constituting an embodiment of the present invention.

Figure 2:
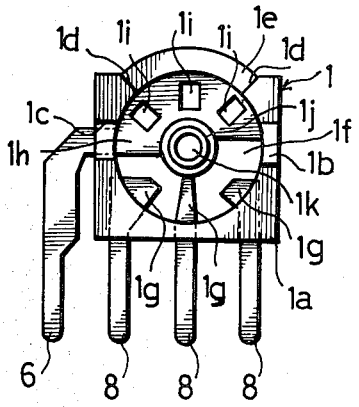
FIG. 2 is a plan view of a switch case member of the embodiment shown in FIG. 1.

Referring to the drawings, reference numerals 1 and 2 each denote respective ones of a pair of case members made of an insulating material, such as a synthetic resin. The case members are generally similar and only one, case member 1, will be discussed in detail. The case member 1 includes a generally circular base portion 1*f* which is surrounded by an upstanding peripheral portion 1*a* of the case member. The peripheral portion 1*a* rises to a height above that of the base portion 1*f*. The upstanding peripheral portion 1*a* is provided with projection 1*b* and recess 1*c*. The projection and recess of the same case member are spaced from one another and lie oppositely from the recess and projection of the other case member. The projections and recesses are engageable by being interfitted in a complementary manner. In the base portion 1*f*, a cylindrical portion 1*j* is provided for supporting a shaft. The cylindrical portion 1*j* projects inwardly from the base portion and has an opening 1*k* extending through the central portion thereof. That section of the base portion 1*f* around the shaft supporting portion 1*j* is provided, as shown in FIG. 2, with a plurality of fixed contacts 1*g* and a common contact 1*h*, which are radially disposed with respect to the shaft supporting portion 1*j*. The common contact 1*h* approaches being semi-circular and is provided with openings or recesses 1*i* arranged radially, the number of which corresponds to that of the fixed contacts 1*g*. The opening 1*i* provide for a clicking or detent operation of the switch, as will be set forth more fully below.

The fixed contacts 1*g* each have a terminal portion 8 integrally formed therewith, and the common contact 1*h* has a terminal portion 6 integrally formed therewith. The contacts 1*g* and 1*h* are fitted in the case member 1 by insert-molding with the free end portions of the terminal portions extending out of the case member 1.

Reference numeral 1*d* denotes respective inclined portions formed at the upper ends of the upstanding peripheral portion 1*a*. These inclined portions 1*d* form a slot 10 therebetween as shown in FIG. 3 when the case members 1 and 2 are joined together in a manner as will be described later. The slot 10 is defined by the inclined portions 1*d* and arc-shaped portions 1*l* and 2*l* of the case members 1 and 2. From this slot 10, a lever portion 5*a* of an operation member 5 is projected. The case member 2 is constructed in the same manner as the case member 1 described in detail above.

Reference numerals 3 and 4 denote movable contact members each made from a resilient metal sheet. The contact member 3 is provided with a circular outer arm portion 3*a* and a circular inner arm portion 3*c*, which are concentrically formed with respect to a central hole 3*e*. From the upper and lower portions of the outer arm portion 3*a*, contacts 3*b* and 3*b'* are projected. Small holes 3*d* are provided in the side portions of the outer arm portion 3*a*. The contact member 4 is constructed in the same manner as the contact member 3 described above. It is necessary that the contact members 3 and 4 be so disposed that the surfaces containing the contacts face outwardly from one another to allow the contacts 3*b*, 3*b'*, and 4*b*, 4*b'* to be engaged with the corresponding fixed contacts or common contacts.

Reference numeral 5 denotes an insulating operation member made, for example, from a synthetic resin and disposed between the movable contacts 3 and 4. Reference numeral 5*a* denotes a stopper portion of the operation member 5, and 5*b* a disc portion thereof integrally formed with the stopper portion. The disc portion 5*b* is provided with a generally rectangular aperture 5*c* through which a shaft member 11 which will be described below is passed, and small cylindrical projections 5*d* extend outwardly from the disc portion so as to lie respectively on opposite sides of the rectangular aperture. The operation member 5 consisting of stopper portion 5*a*, disc portion 5*b*, rectangular aperture 5*c*, and small projections 5*d* is molded in a manner similar to that of the case members 1 and 2.

Reference numeral 11 denotes a shaft member having a larger diameter portion 11*a*, a generally rectangular portion 11*b* connected to the larger diameter portion, and a thin cylindrical portion 11*c* connected to the rectangular portion. The rectangular portion 11*b* is fitted in the rectangular aperture 5*c* in the operation member 5 for rotation therewith.

Reference numeral 12 denotes a fastener member, for example a speed nut, through which the thin cylindrical portion 11*c* of the shaft member 11 is inserted so as to project from a central aperture of one of the case members.

The switch according to the present invention consists of the above-mentioned parts, and the assembling of these parts will be described below.

First, the small projections 5*d* provided on both faces of the disc portion 5*b* of the operation member 5 are fitted into the corresponding small holes 3*d* and 4*d* of the movable contact members 3 and 4. Then, the ends of the small projections 5*d* are tightened down to secure the contact members 3 and 4 to respective faces of the operation member 5. Thereafter, the front end portion of the rotary shaft 11 is inserted into the opening 1*k* in the shaft support 1*j* provided on the inner surface of the casing member 1 and pushed forwardly through the central aperture 3*e* of the movable contact 3, rectangular aperture of the operation member 5, central aperture 4*e* of the movable contact 4, and passage 2*k* in the shaft support 2*j* provided on the inner surface of the casing member 2, so as to be projected from the outer surface of the casing member 2. The end portion of the rotary shaft 11 projected from the outer surface of the casing member 2 is fitted under pressure into the speed nut 12 which is fixed on a flange 2*m* provided on the outer surface of the casing member 2. When the rotary shaft 11 is thus fixed, the casing members 1, 2 are unrotatably joined together as the projection 1and recess 1*c* provided on and in the projected periphery 1*a* of the casing member 1 are engaged with the recess 2*c* and projection 2*b* provided in and on the casing member 2. At this time, the shaft supporting portion 1*j* and 2*j* (the shaft supporting portion 2*j* is not shown) of the case members 1 and 2 have been inserted into the central holes 3*e* and 4*e* of the movable contact member 3 and 4. Thus, the contact members 3 and 4 are housed in the circular base portions 1*f* and 2*f* and resiliently contact the inner surface thereof so that the contacts 3*b* and 4*b* and contacts 3*b'* and 4*b'* can be slid on the common contacts 1*h* and 2*h*, and fixed contact 1*g* and 2*g*, respectively.

The projections 1*b* and 2*b*, and recesses 1*c* and 2*c* are engaged with one another to prevent the case members 1 and 2 from being relatively rotated. When the case members are joined together in the above-described manner, a slot 10 as shown in FIG. 3 is formed, which is defined by the arc-shaped portions 1*l* and 2*l* and the inclined portions 1*d* and 2*d*. From this slot 10, the stopper portion 5*a* of the operation member 5 is outwardly extended, and this stopper portion 5*a* can be rotated between the opposed inclined portions while being guided along the slot 10.

Now, the operation of the switch according to the present invention will be described.

When the shaft member 11 is rotated in either direction, the contacts 3*b'* and 4*b'* on the movable contact members are engaged with and disengaged from, in order, the fixed contacts 1*g* and 2*g*; and the other contacts 3*b* and 4*b* slide along the common contacts 1*h* and 2*h*. As can be seen in FIG. 4, the contacts 3*b* and 4*b* make effective contact engagement with the common contact 1*h* at each respective location 1*i*. Thus, electrical switching can be effected via the respective terminal portions 8 and 6. The shifting actions between the fixed contacts will be transmitted in a stepped manner to the operator owing to the openings or recesses 1*i* and 2*i* provided in the common contacts and corresponding to the fixed contacts.

As has been described above, the case members 1 and 2 are provided with fixed contacts 1*g* and 2*g* and common contacts 1*h* and 2*h*, which are integrally formed therewith, and then, a case member with fixed contacts and common contact can be handled as a unit part. The operation member 5 has movable contacts 3 and 4 which are attached thereto and they also constitute an integral unit. Therefore, the switch according to the present invention can be easily assembled by merely combining four parts, i.e. case members 1 and 2, operation member 5, and shaft member 11. This allows the assembling efficiency to be increased to a great extent. Since the fixed contacts 1*g* and 2*g* are buried in the case members 1 and 2, the surface thereof and the bottom surfaces of the circular base portions 1*f* and 2*f* are in the same planes. Consequently, wear on the contacts 3*b* ' and 4*b'* is remarkably reduced. Furthermore, the opposed inclined portions 1*d* and 2*d* provided on the peripheral portions 1*a* and 2*a* of the case member 1 and 2 serve to receive the stopper portion 5*a* of the operation member 5 and thus, no additional means for restricting the rotary movement of the stopper portion is required. Then, the present invention can provide a switch of a small thickness and simple construction, which is made of a reduced number of parts and which has excellent assembling efficiency.

The present invention not, of course, limited to the above-described embodiment; it may be modified in various ways within the scope of the appended claims.

What is claimed is:

1. A switch comprising a first and second case member each including a recessed base portion having a central opening therethrough, said case members being joined together with the recesses of said base portions facing one another to form a central space;

each of said case members having a respective plurality of fixed contacts and a single common contact fixed within the recess of its base portion so as to lie around said opening therein, each of said contacts having a terminal portion extending outwardly from the respective case member;

an operation member having a disc member disposed rotatably within said space and a stopper portion extending outwardly through a slot in said joined case members for restricting the rotary movement of said operation member about the axis of said central openings;

a first and second contact member each secured to respective faces of said disc portion and slidable along the contacts within a recess of a respective base portion to enable selective switching between the contacts;

a rotatable shaft member passed through said case members, said first and second contact members and said disc member for rotating said disc member by actuation of the shaft member, said shaft member having an end portion extending outwardly from one of said case members; and a fastener member attached to said end portion of the shaft member for holding said case members together.

2. A switch according to claim 1, said contacts and their unitary terminal portions being integral with their respective case members.

3. A switch according to claim 1, a plurality of recessed portions corresponding in number to the number of fixed terminals being provided in the recess of each base portion, said recessed portions providing detent operation of the respective contact member as it is moved thereover.

4. A switch according to claim 3, said recessed portions being formed in the respective common terminal.

5. A switch according to claim 1, the adjoining surfaces of said case members being provided with projections and recesses complementary to one another so as to be mutually interfitted.

6. A switch according to claim 1, each case member having a peripheral portion raising about the base portion thereof, said peripheral portions each having arcuate cutout portions which, when joined together, form said slot for receiving said stopper portion.

7. A switch according to claim 6, the end portions of said cutout portions serving as stoppers for limiting the range of motion of said stopper portion.

8. A switch according to claim 1, the operation member having a generally rectangular opening through which the shaft member is passed.

9. A switch according to claim 1, each of said base portions having cylindrical supporting portions extending inwardly from the openings therein.

10. A switch according to claim 9, said first and second movable contact members each having a central hole fitting over said supporting portions.

11. A switch according to claim 1, each face of said disc portion being provided with respective projections on which said first and second contact members are fitted.

12. A switch according to claim 11, said operation member is unitarily formed from a synthetic resin.

13. A switch according to claim 11, said first and second contact members each having holes fitting over respective projections of said disc member.

* * * * *